United States Patent [19]

Falk

[11] Patent Number: 4,594,637

[45] Date of Patent: Jun. 10, 1986

[54] DIGITAL ELECTRONIC LOCK SYSTEM

[76] Inventor: Sidney Falk, 3000 N. River Rd., River Grove, Ill. 60171

[21] Appl. No.: 703,813

[22] Filed: Feb. 21, 1985

[51] Int. Cl.[4] ..... H01H 47/00

[52] U.S. Cl. ..... 361/172

[58] Field of Search ..... 361/171, 172

[56] References Cited

U.S. PATENT DOCUMENTS 3,812,403 5/1974 Gartner ..... 361/172

4,509,092 4/1985 Invernizzi ..... 361/172

*Primary Examiner*—Michael L. Gellner

*Attorney, Agent, or Firm*—Leydig, Voit & Mayer, Ltd.

[57] ABSTRACT

An apparatus for electronically controlling the activation of a lock-release mechanism comprising a small, lightweight portable housing that can be easily carried and includes electromechanical means for converting mechanical movement initiated by an operator to electrical signals and an energization source for powering both the electromechanical means and the lock-release mechanism. The lock-release mechanism includes an electronic decoder and detector for receiving the signals generated by the electromechanical means and for receiving power from the energization source within the portable housing. In response to a correct signal code, the electronic decoder and detector in the lock-release mechanism releases an associated lock, thereby freeing the structure secured by the lock.

12 Claims, 5 Drawing Figures

DIGITAL ELECTRONIC LOCK SYSTEM

TECHNICAL FIELD

This invention is directed to automatic lock release mechanisms for releasing locked devices and, more particularly, to automatic lock release mechanisms for coin operated vending machines and the like.

BACKGROUND

Ordinarily, vending machines utilize mechanical locks in connection with their coin boxes which obviously require mechanical keys to unlock. These types of locks are fairly expensive and, furthermore, the coin boxes secured by these locks have security limitations in that most mechanical locks are susceptible to being picked open.

Recently, electronic locks have replaced mechanical locks in many applications. These devices typically include a keypad or electromagnetic device for entry of a predetermined number sequence into a detector which only responds to the entry of the predetermined number sequence.

Automobiles have recently been made available with electronic door locks which are operated from keyboards mounted on the doors of the automobile. In an automobile, a battery is required for starting the engine; therefore, no additional power source is required to provide an electronic lock. Typically, these electronic locks are in addition to mechanical locks since the electronic locks alone are subject to failure if, for instance, the car battery is discharged to a degree where it cannot energize the locking mechanism. Such an occurrence may easily happen if the driver forgets to turn off the lights of the car.

Because electronic locks are dependent on the condition of their power sources, they are comparatively unreliable. The inability of an electronic lock to function if its power source fails has prevented electronic locks from finding applications more widespread than the securing of entrance doors in buildings or in automobiles.

In addition to the comparative unreliability of electronic locks, they are also expensive. Although the electronic components for an electronic lock are considerably cheaper than the components of a mechanical lock, the added cost of a battery brings the total cost of the electronic lock to a level comparable with the cost of a mechanical lock. The use of an a-c power outlet may reduce the cost of an electronic lock, but its reliability is sacrificed since a simple power outage makes the lock inoperable. A battery backup may be added as an emergency power source, but the additional cost of the battery reduces the attractiveness of an electronic lock as an alternative to a standard mechanical lock.

In lock applications where a battery represents an item that is otherwise not needed and also represents a significant expense in view of the total cost of the object being locked, the substitution of an electronic lock for a mechanical lock is likely not to be commercially feasible. Also, for high reliability, the electronic lock may require a mechanical lock as a backup to protect against battery failure or A-C power failure. In situations where such a backup is necessary, the electronic lock becomes merely an additional lock with its associated added expense. Therefore, electronic locks have been limited in the scope of their applications because of the foregoing practical considerations which make electronic locks, as previously available, unacceptable alternatives to mechanical locks in many environments.

SUMMARY OF THE INVENTION

A general object of the invention is to provide an electronic lock which overcomes the foregoing disadvantages. In this connection, it is also an object of the invention to provide an electronic lock which may be a practical substitute for a mechanical lock in vending machines and the like.

A more specific object of this invention is to provide an inexpensive electronic lock and key combination which can provide inexpensive and reliable protection and service for vending machines and the like.

In accordance with the invention, an apparatus is provided for electronically controlling the activation of a lock-release mechanism and the lock associated therewith wherein the apparatus includes a lightweight portable housing enclosing an electromechanical means for converting mechanical movement initiated by an operator of the apparatus into electrical signals and also an energization source for powering both the electromechanical means and the lock-release mechanism. The portable housing includes a first connector for providing output ports for the electronic signals from the energization source and from the electromechanical means. The lock-release mechanism is mounted to a stationary fixture and includes a second connector for receiving the connector of the portable housing. The lock-release mechanism receives its energization from the energization source in the portable housing. A decoder and detector in the lock-release mechanism decodes the electrical signals from the electromechanical means and detects a predetermined sequence of the signals. In response to the detection of the predetermined sequence, the lock-release mechanism releases the lock associated with the mechanism and thereby frees the mechanism from its mount on the stationary fixture.

While the invention will be described in connection with a preferred embodiment, there is no intent to limit it to that embodiment. On the contrary, the intent is to cover all alternatives, modifications and equivalents included within the spirit and scope of the invention as defined by the appended claims.

DETAILED DESCRIPTION OF THE PREFERRED EMBODIMENT

Figure 1:
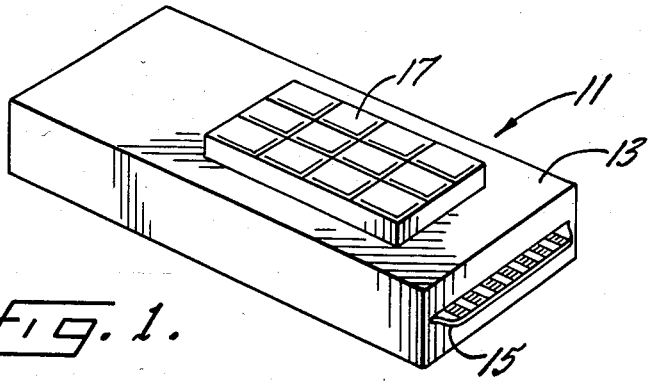
FIG. 1 is a perspective view of the portable housing enclosing an encoder and energization source according to the invention.

Turning to the drawings and referring first to FIG. 1, a portable activation device is provided for unlocking a coin box or the like secured by a lock-release mechanism and a lock associated therewith. The portable actuator device 11 includes a housing 13 with a male connector 15 providing an output for signals encoded from a keypad 17. The portable actuator device 11 is preferably small enough to be hand held and sufficiently light in weight to be easily carried. As will be explained in greater detail hereinafter, selection of a predetermined sequence of keys on the keypad 17 generates corresponding electrical signals on the male connector 15.

Figure 2:
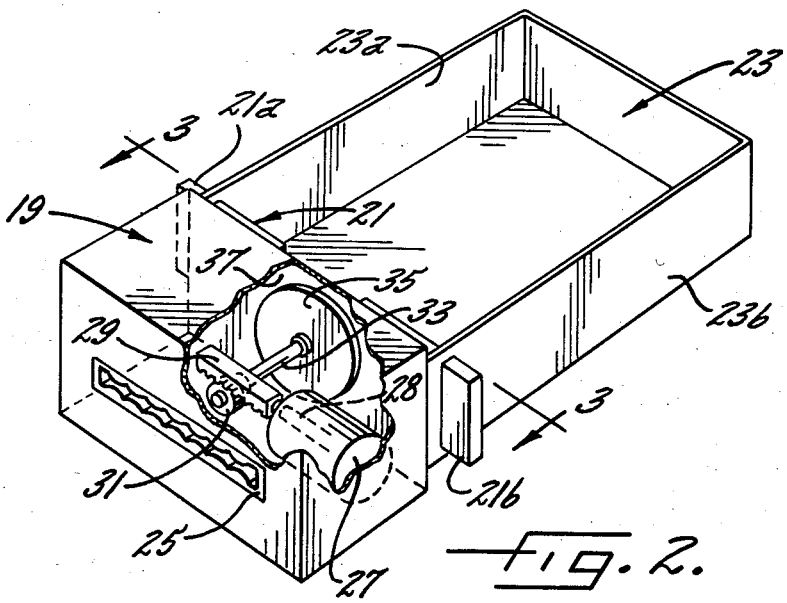
FIG. 2 is a perspective view, partially cut away, of a lock-release mechanism and a lock associated therewith which receives electrical signals from the portable housing of FIG. 1 in accordance with the invention.

Referring to FIG. 2, a lock-release mechanism 19 is associated with a deadbolt lock 21 which secures a cash box 23 to a stationary fixture such as a vending machine (not shown). The cash box 23 holds coins received by the vending machine. The cash box 23 is not a necessary part of the lock-release mechanism 19. It is shown here merely to illustrate the invention in the environment of a vending machine.

Periodic removal of the cash box 23 from the vending machine is necessary in order to empty the coins from the cash box. Unauthorized removal and emptying of the cash box 23 is prevented by the lock-release mechanism 19. Recesses (not shown) in the vending machine or the like receive the end portions 21*a* and 21*b* of the dead-bolt lock 21 and thereby lock the cash box 23 safely inside the housing of the vending machine. In order to release the cash box 23 from the housing of the vending machine, the two portions 21*a* and 21*b* of the deadbolt lock 21 are moved inwardly with respect to the sidewalls 23*a* and 23*b* of the cash box 23 from their positions shown in FIG. 2. Movement between the lock position shown in FIG. 2 and an unlocked position is controlled by the lock-release mechanism 19.

The linkage mechanism joining the armature 28 to the deadbolt lock 21 includes a linear gear 29 mounted on the armature and meshed with a circular gear 31 which in turn is mounted on a stem 33 of a rotational wheel 35. Linear movement of the gear 29 by the armature 28 rotates the gear 31 and the integrally attached stem 33 and wheel 35.

Figure 3:
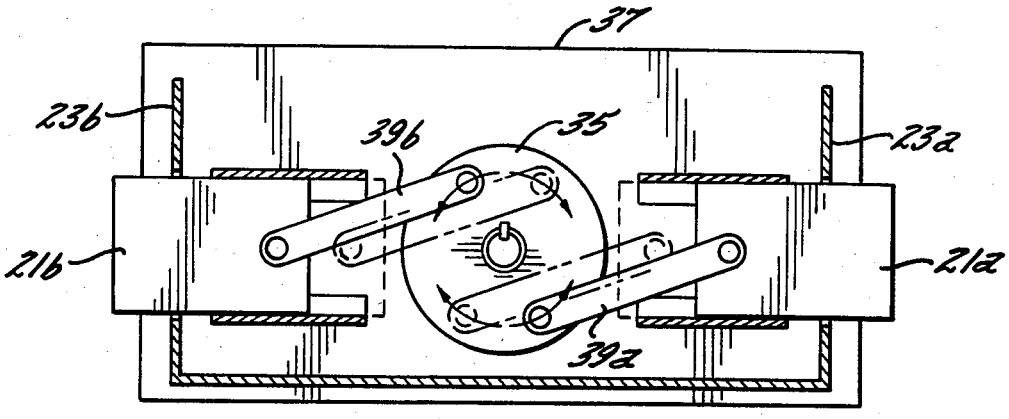
FIG. 3 is a plan view of the lock associated with the lock-release mechanism of FIG. 2 taken along the line 3—3.

Referring to FIG. 3, also included in the linkage mechanism are linkages 39*a* and 39*b* which join deadbolt portions 21*a* and 21*b*, respectively, with the wheel 35. By joining the linkages 39*a* and 39*b* at diametrically opposite positions on the wheel 35, rotation of the wheel 35 moves the deadbolt portions 21*a* and 21*b* in opposite directions. For example, rotation of the wheel 35 in a counterclockwise direction cause the linkage 39*a* to move the deadbolt portion 21*a* in a rightward direction as viewed in FIG. 3. In contrast, for the same counterclockwise rotation by the wheel 35, the linkage 39*b* moves the deadbolt portion 21*b* in a leftward direction. Clockwise rotation of the wheel 35 reverses the movement of the deadbolt portions, i.e., both portions move inwardly toward the wheel.

The wheel 35 is mounted in a wall 37 joining the lock-release mechanism 19 to the cash box 23. Activation of the solenoid 27 causes the wheel 35 to rotate in a clockwise direction as viewed in FIG. 3. Correspondingly, deactivation of the solenoid 27 rotates the wheel 35 in a counterclockwise direction. The end points of the rotation of wheel 35 delineate the locked (solid lines) and unlocked (dashed lines) positions of the deadbolt portions 21*a* and 21*b*.

Figure 4:
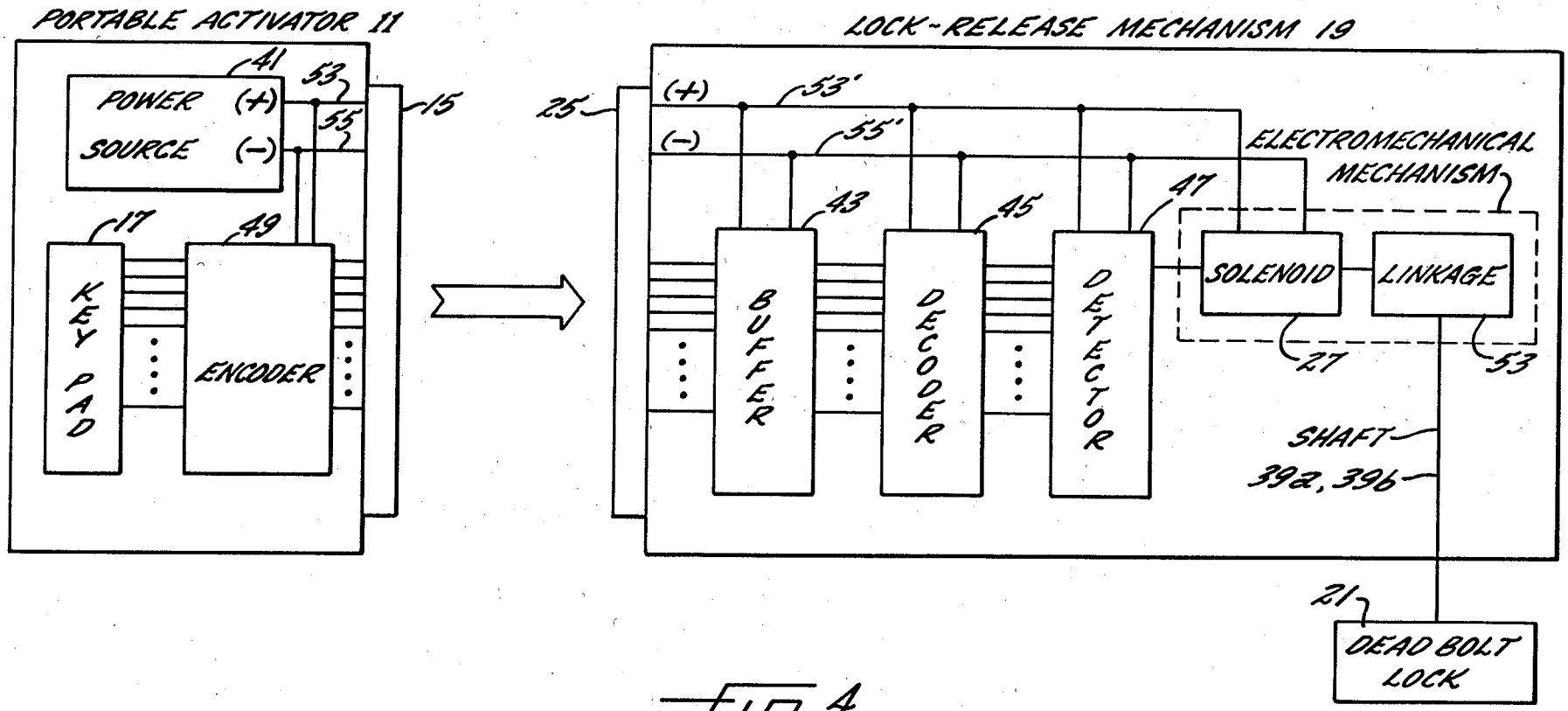
FIG. 4 is a block diagram of the portable activator and the lock-release mechanism according to the invention.

Referring to FIG. 4, in accordance with the invention, the portable actuator 11 includes a power source 41 containing sufficient capacity to also provide a power source for the lock-release mechanism 19 by way of mating connectors 15 and 25. When the portable actuator 11 is fitted to the lock-release mechanism 19 by the connectors 15 and 25, power is transferred from the actuator to the lock-release mechanism thereby reliably enabling the circuitry of the mechanism including the solenoid 27.

In the illustrative embodiment, the circuitry of the lock-release mechanism 19 includes a buffer 43, a decoder 45, a detector 47 and the solenoid 27. Each of the foregoing electronic elements solely depends upon the power source 41 as its source of energy. One portable actuator 11 may unlock a plurality of lock-release mechanisms 19 by entry of unique sequences to the keypad 17 (FIG. 1) as will be explained in greater detail hereinafter. Since the actuator 11 is portable, it can be stored in a battery charger or similar apparatus in order to provide highly reliable operation of the lock-release mechanism 19.

In order to energize the lock-release mechanism 19, the portable actuator 11 is joined to the lock-release mechanism by plugging the male connector 15 into the female connector 25. When the portable actuator 11 is joined to the lock-release mechanism 19, power is transferred from the power source 41 to the circuitry of the lock-release mechanism 19. In response to the pressing of a correct sequence of keys on the keypad 17, a solenoid 27 will be activated such that the linear motion of its armature 28 moves the portions 21*a* and 21*b* of the deadbolt lock 21 inwardly. To provide for this inwardly movement, the armature 28 is operatively coupled to the deadbolt lock 21 by the linkage mechanism 53. (The detailed description of the linkage mechanism 53 is given in connection with FIGS. 2 and 3.) The linkage mechanism 53 converts the linear movement of the solenoid 27 to opposite linear movements of the two deadbolt portions 21*a* and 21*b*.

In response to electrical signals generated by the keypad 17, the lock-release mechanism 19 decodes the signals and detects a match between a predetermined sequence of signals and the sequence generated from the keypad. If the predetermined sequence and the sequence generated by the keypad 17 are the same, the solenoid 27 of the lock-release mechanism 19 is energized thereby causing the cash box 23 to be released from its associated stationary fixture, e.g., a vending machine. In the decoder 45, the sequence of electronic signals received from the portable actuator 11 is prepared for delivery to the detector 47. Depending upon the precise nature of the detector 47 and the decoder 45, the decoder 45 may simply reroute the signals from the activator 11 to designated input lines for the detector 47 or, alternatively, the decoder 45 joins with the encoder 49 in the portable actuator 11 to provide a formated communications link between the activator 11 and the mechanism 19. The formating of the signal generated from the keypad 17 provides an extra measure of security for the lock-release mechanism 19.

Preferably, the detector 47 responds to a predetermined sequence of signals generated by the keypad 17 in the portable actuator 11. For a keypad input, the sequence of signals represents keys of the keypad pressed in a predetermined sequence which, when decoded by the decoder 45, will match a predetermined stored sequence in the detector 47. Alternatively, the correct sequence of signals may be stored in a memory (not shown) in the portable actuator 11, and, to transfer the correct sequence from memory to the circuitry of the lock-release mechanism 19, a single key on the keypad 17 may be used to initiate the transfer. When a match occurs between the entered sequence and the stored predetermined sequence, the detector 47 enables the solenoid 27 to receive power from the power source 41. In response to the application of power from the power source 41, the linkage 53 responds to the movement of the armature 28 of the solenoid, thereby moving the deadbolt lock 21 from its locked position to its unlocked position.

Positive and negative outputs of the power source 41 are coupled to the positive and negative inputs of the buffer 43, decoder 45, detector 47 and solenoid 27 by way of male and female connectors 15 and 25, respectively, which join the power lines 53 and 55 in the portable actuator 11 with the power line 53' and 55' in the lock-release mechanism 19. Because tampering with the lock-release mechanism may result in damage to the decoder 45 and/or detector 47, the buffer 43 protects the decoder and detector from electrical signals which, may harm them if the signals are free to reach the inputs of the decoder or the detector.

Figure 5:
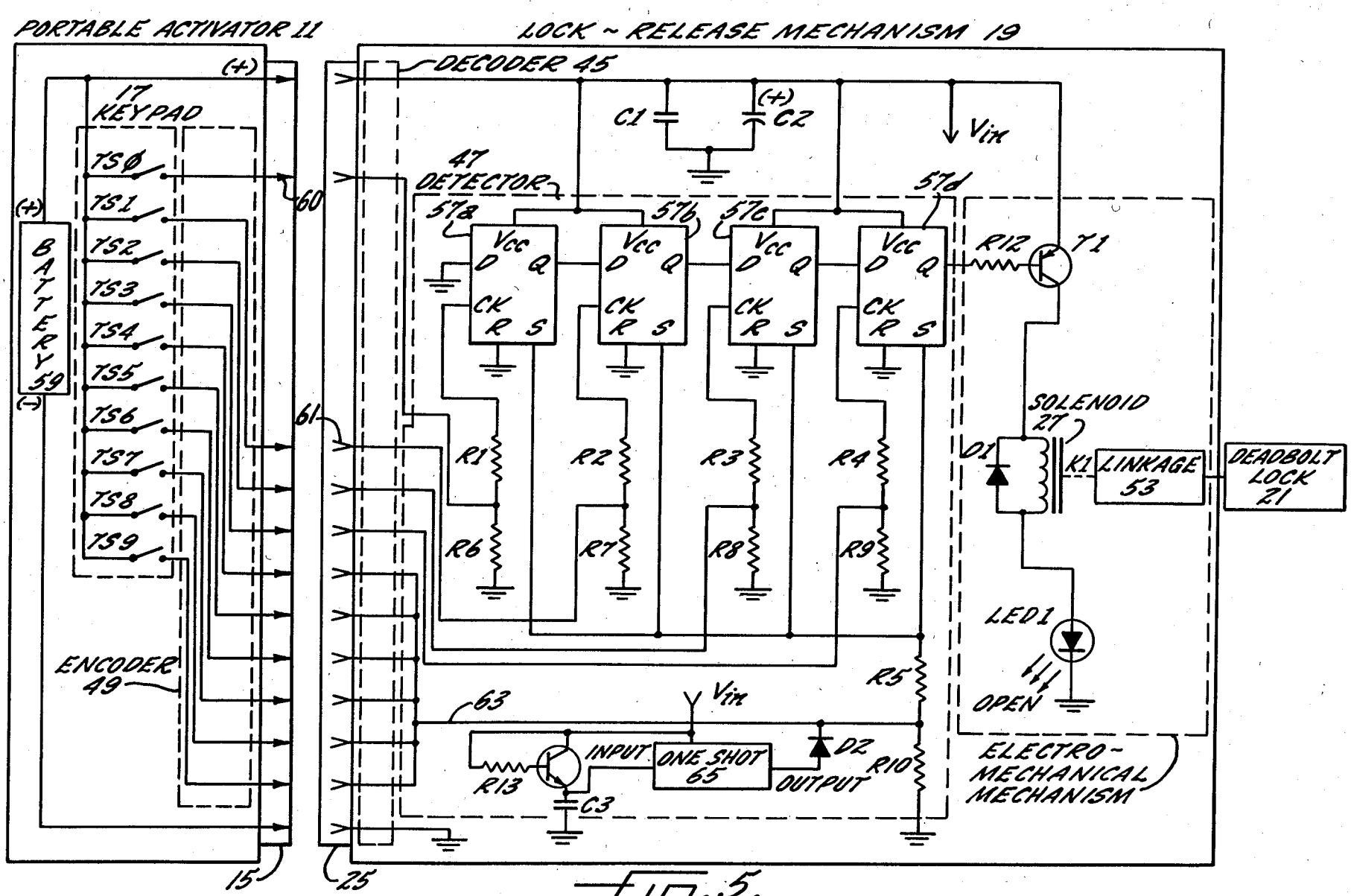
FIG. 5 is a schematic diagram of an exemplary embodiment of the portable activator and the lock-release mechanism according to the invention.

Referring to FIG. 5, an exemplary embodiment of the portable actuator 11 and the lock-release mechanism 19 includes a detector 47 comprising a plurality of cascaded flipflops 57*a–d* which cooperate to turn on a transistor T1 only if the flipflops are set in a predetermined sequence by the signals from the keypad 17 of the actuator 11. The cascaded arrangement of the flipflops 57*a–d* is representative of a stored sequence of signals in the sense that only a predetermined sequence will result in a high Q output at the last flipflop 57*d*. Therefore, as indicated in connection with the block diagram of FIG. 4, the flipflops 57*a–d* (detector 47 in FIG. 4) function to compare the generated sequence of a signals with a predetermined sequence and indicate a match (i.e., a high Q output from flipflop 57*d*) only when the two sequences are the same. A relatively simple encoder 49 is implemented by arranging the output lines for switches TS1–TS9 of the keypad 17 to describe a particular pattern on the array of connector pins 60 of the connector 15. Correspondingly, the input lines of the decoder 45 describe a pattern on the array of connector pins 61 of connector 25 which match the pattern of the connector pins 60 in connector 15. The output lines from the decoder 45 provide inputs to the clock inputs for the flipflops 57*a–d*.

For the specific encoder 49 in FIG. 5, the TS0 switch is located at the uppermost pin 60 of the connector 15 and the remaining switches TS1 through TS9 are located in the lowermost pins of the connector 15. Correspondingly, the input lines to the decoder 45 are connected to the particular connector pins 61 in female connector 25 corresponding to the appropriate male connector pin 60 such that each of the switches TS0 through TS9 may deliver an input signal to the decoder 45. The foregoing arrangement allows for a formating of the signal from the portable activator 11 to the lock-release mechanism 19. More sophisticated formating such as the utilization of distinct frequencies for each switch may also be used with this invention if desired. If the encoder 49 generates frequency signals in response to the closure of any of the switches TS0 through TS9, then the decoder 45 must function to activate certain of its output lines in response to particular frequencies.

In operation, the particular decoder 45 and detector 47 shown in FIG. 5 require the following sequence of key closures in order to activate the deadbolt lock 21: TS0, TS1, TS2 and TS3. A voltage divider network for each of the flipflops 57*a–d* protects the clock input of the flipflop from the full voltage of the battery 59. Specifically, the voltage divider networks R1/R6, R2/R7, R3/R8 and R4/R9 provide reduced voltage to the clock inputs of the flipflops 57*a*, 57*b*, 57*c* and 57*d*, respectively. Closing the switches TS0 through TS3 in sequence causes the low input at the D input terminal of the flipflop 57*a* to be transferred to the Q output of the flipflop 57*d*. The output of the flipflop 57*d* powers the transistor T1 by way of resistor R12. By biasing transistor T1 to an on condition, current from the battery 59 flows through the transistor T1 and activates the solenoid 27 which causes the deadbolt lock 21 to release the cash box 23.

If one of the switches in the sequence, TS0 through TS3 is closed out of sequence, the associated flipflop will not have the low level originating from flipflops 57*a* at its input and, therefore, will not pass the low level forward toward flipflop 57*d*. For example, if the switch TS0 is first pressed, the low level input of the flipflop 57*a* will pass to the Q output of the flipflop; but, if the next switch chosen is TS2, the clock input to the flipflop 57*c* will toggle and, thereby, transfer a high from its D input to its Q output. Further, pressing of the switches in their correct sequence will not results in the energization of the solenoid 27 because there has been a break in the sequence of numbers necessary to transfer the low level D input of the flipflop 57*a* to the Q output of flipflop 57*d*.

Also, if one of the switches not used in the sequence such as TS7 is pressed by the user, the decoder activates line 63 which causes all of the flipflops 57*a–*57*d* to set their outputs. By setting the outputs of the flipflops 57*a–d* in response to the selection of a switch not part of the sequence, the decoder 45 and detector 47 insure that the low input to the flipflop 57*a* cannot be walked through the flipflops 57*b–d* by simply pressing enough keys until the low level signal is worked through all the flipflops to the output of flipflop 57*d*. A voltage divider R5/R10 is provided to buffer the set inputs to the flipflops 57*a–d*.

A diode D1 is in parallel with the coil K1 of the solenoid 27 in order to provide a feedback path for the solenoid current when the transistor T1 is turned off. In order to indicate that the solenoid 27 is activated and the deadbolt lock 21 released, a LED is provided in a series connection with the solenoid 27. The particular flipflops 57*a–d* are commercially available D-type flipflops. An example of a D-type flipflop suitable for use in connection with the invention is COS/MOS digital integrated circuit CD4013B. In order to protect the $V_{cc}$ inputs to the flipflops 57*a–d* from voltage and/or current spikes occurring when the portable actuator 11 is joined to the lock-release mechanism 19, capacitors C1 and C2 are connected between the positive and negative connector pins 61 of connector 25 for receiving voltage potential from the battery 59.

In order to insure that all of the flipflops 57*a–d* are in a high output state when the portable actuator 11 is connected to the lock-release mechanism 19, a one shot circuit 65 receives at its input a delayed voltage from the battery 59. By slightly delaying the voltage signal from the battery, the one shot circuit 65 is given sufficient time to become fully operational before responding to an input signal. To delay the appearance of the battery signal at the input to the one-shot circuit 65, a current control arrangement comprising a transistor T2 and a resistor R13 control the charging rate of a capacitor C3. The voltage at the anode of the capacitor C3 is directed to the input of the one-shot circuit 65. When the voltage at the anode of the capacitor C3 reaches a sufficient amplitude, the one-shot circuit 65 triggers a momentary high output on the set line 63. This high output on line 63 sets each of the flipflops 57*a–d*, thereby initializing the detector 47. The diode D2 isolates the output of the one-shot circuit 65 from the line 63 such that the one-shot circuit 65 is effectively removed from the circuit after its output pulse is completed.

In summary, the invention provides a battery or other voltage source in a portable actuator which is capable of energizing electronic circuitry in a lock-release mechanism wherein this latter circuitry, when energized, is responsive to a selected sequence of input signals generated by the portable actuator. It will be appreciated from the foregoing detailed description that because the system does not require a power source in the lock-release mechanism, the reliability problems of prior art electronic locks is avoided. In addition, the electronic lock system of the invention can be competitively priced with available mechanical locks since only one power source is needed for a large number of lock-release mechanisms. Theoretically, one power source may operate as many lock-release mechanisms as there is sequence combinations of signals generated from the keypad 17. In practice, the number is limited to the amount of vending machines or the like that can be serviced at reasonably periodic intervals by a single portable actuator 11.

I claim:

1. In an electronic lock system for operating an electromechanical lock having an input port for electronic signals, an electronic key comprising, in combination:

a portable housing containing a power source for generating power signals and including input means for generating electronic signals; and means for detachably joining the portable housing to the input port of said electromechanical lock and transferring said power signals to said electromechanical lock wherein said power signals are its sole source of power.

2. In the electronic lock system set forth in claim 1 said power source supplies power to a decoder, a detector and a locking mechanism in said electromechanical lock.

3. In the electronic lock system set forth in claim 2, said detector responds to a predetermined sequence of signals generated by said input means.

4. In the electronic lock system set forth in claim 3, said detector energizes said locking mechanism only in response to receiving said predetermined sequence of signals.

5. In the electronic lock system set forth in claim 4, said detector includes means for resetting in response to an out-of-sequence signal from said input means.

6. An electronic key as set forth in claim 1 wherein said portable housing includes an encoder responsive to signals generated by said input means.

7. An electronic key as set forth in claim 6 wherein said input means is a keypad.

8. An electronic key as set forth in claim 7 wherein said input and output ports are pin connectors.

9. An apparatus for electronically controlling the activation of a lock-release mechanism, said apparatus comprising:

a small, lightweight portable housing capable of being easily carried;

an input means associated with said housing for converting instructions initiated by an operator of said apparatus into electrical signals;

an energization source within said housing for powering said input means, said energization source having at least two terminals;

a first connector integral with said housing and providing output ports for the electrical signals of said input means and the terminals of said energization source;

a lock-release mechanism and a lock associated therewith mounted to a stationary fixture;

a second connector for electronically mating with said first connector, said second connector being integrally mounted with said lock-release mechanism;

an electronic decoder and detector means in said lock-release mechanism for receiving said electrical signals from said input means and for receiving power from said energization source when said first and second connectors are joined; and said electronic decoder and detector means being responsive to a predetermined coded signal to transfer power from said energization source to said lock-release mechanism thereby releasing the lock associated with said lock-release mechanism.

10. A method for energizing a lock-release mechanism integrally associated with a stationary device secured by a lock wherein said lock-release mechanism has an electrical input port for receiving power and control signals from a portable activator having an electrical output port, said method comprising the steps of:

mating said electrical output port of said portable activator with said electrical input port of said lock-release mechanism;

transferring electrical power to a decoder and a detector in said lock-release mechanism from a power source in said portable activator;

transmitting from said portable activator a predetermined signal sequence from said output port and into said input port of said lock release mechanism;

decoding said predetermined signal sequence;

detecting said predetermined signal sequence and, in response thereto, releasing said lock;

opening said stationary device unlocked by said lock-release mechanism; and decoupling said input and said output ports so that said portable activator is detached from said lock-release mechanism and removed to a remote location where it is physically and electronically isolated from said lock-release mechanism.

11. An apparatus for unlocking a locking mechanism comprising in combination:

a portable actuator comprising;

a power source, an input means energized by said power source for converting electromechanical signals generated by mechanical movement initiated by an operator to coded electrical signals, an output port having outputs for said input means and said power source, and a lock-release mechanism comprising;

an input port for detachably mating with said output port of said portable actuator, a decoder for decoding said coded electrical signals from said input means by way of said input port, said decoder being supplied with power from said power source in said portable actuator by way of the coupling between said input and output ports, a detector for receiving decoded signals from said decoder, said detector also being supplied with power from said power source in said portable actuator by way of the coupling between said input and output ports and said detector generating an output signal in response to detecting a predetermined signal from said input means, and an electromechanical means and a lock associated therewith responsive to said output signal from said detector for unlocking said lock, said electromechanical means being supplied with power from said power source in said portable actuator by way of the coupling between said input and output ports.

12. An apparatus for unlocking a locking mechanism and for receiving a portable actuator which includes a signal input means, power pack and output port, said apparatus comprising:

an input port connected to a physically accessible area of said locking mechanism for mating with said output port of said portable actuator for transmitting to said apparatus signals from said signal input means and power from said power pack;

a decoder for decoding signals from said signal input means received by way of said output and input ports, said decoder being supplied with power from said power pack by way of said output and input ports;

a detector for receiving decoded signals from said decoder and being supplied with power from said power pack, said detector generating an output signal in response to receiving a predetermined decoded signal; and an electromechanical means response to said output signal from said detector for unlocking said locking mechanism, said electromechanical means being supplied with power from said power pack by way of said input and output ports.

* * * * *